US006932228B1

(12) United States Patent
Darr et al.

(10) Patent No.: US 6,932,228 B1
(45) Date of Patent: Aug. 23, 2005

(54) STACKABLE PLASTIC CONTAINER

(75) Inventors: Richard C. Darr, Medina, OH (US); James C. Dorn, Norton, OH (US); Richard A. Lovelace, Jr., Cuyanoga Falls, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 10/894,378

(22) Filed: Jul. 19, 2004

Related U.S. Application Data

(63) Continuation-in-part of application No. 29/204,429, filed on Apr. 29, 2004.

(51) Int. Cl.[7] ..... B65D 21/00
(52) U.S. Cl. ..... 215/10; 206/509; 220/23.4
(58) Field of Search ..... 206/503, 504, 206/515, 518, 520, 509; 215/10; 220/23.4

(56) References Cited

U.S. PATENT DOCUMENTS

| | | | | |
|---|---|---|---|---|
| D201,580 | S * | 7/1965 | Dike | D9/560 |
| 3,369,658 | A * | 2/1968 | Heinz | 206/430 |
| 3,374,917 | A * | 3/1968 | Troy | 220/23.4 |
| 4,308,955 | A * | 1/1982 | Schieser et al. | 206/509 |
| 5,927,499 | A * | 7/1999 | Vesborg | 206/509 |
| D412,646 | S * | 8/1999 | Credle, Jr. | D7/625 |
| 6,276,549 | B1 * | 8/2001 | Fasci et al. | 220/23.4 |
| 6,588,612 | B1 * | 7/2003 | Dorn et al. | 215/10 |

* cited by examiner

*Primary Examiner*—Joseph C. Merek
(74) *Attorney, Agent, or Firm*—Robert H. Bachman

(57) ABSTRACT

Stackable plastic container including side portions having at least one of generally centrally located protrusions and depressions which nest with at least one of generally centrally located matching protrusions and depressions of a second container, and with the base portion including a generally centrally located depression which nests with a generally centrally located pouring spout of a second container.

17 Claims, 8 Drawing Sheets

STACKABLE PLASTIC CONTAINER

CROSS REFERENCE TO RELATED APPLICATIONS

This application is a continuation-in-part of copending U.S. patent application Ser. No. 29/204,429, filed Apr. 29, 2004.

BACKGROUND OF THE INVENTION

Plastic containers are widely used commercially for a variety of products. These include plastic containers of widely varying sizes depending on the particular product and the commercial needs. For example, it is not uncommon to have plastic containers having a capacity of one gallon, two gallons, or more.

It is highly desirable to provide a plastic container which is stackable while at the same time providing desirable commercial characteristics, such as convenience in use and handling, reusability and desirable aesthetic characteristics. Also, the container must be able to be securely stacked as on a pallet in multiple tiers without requiring intermediate stacking pallets. Secure stackability is particularly important for hazardous liquids. Moreover, bulky or large size plastic containers present a particularly difficult problem for stackability in view of their often flexible walls.

It is particularly desirable to provide a plastic container as aforesaid which is resistant to vacuum and yet provides a simple, aesthetically pleasing structure which is suitable for a secure nesting arrangement with other like containers.

Accordingly, it is a principal objective of the present invention to provide a plastic container which is stackable.

It is a further object of the present invention to provide a stackable plastic container as aforesaid which has desirable commercial characteristics, such as reusability and pleasing aesthetic features.

It is a still further objective of the present invention to provide a stackable container as aforesaid which can readily be stacked in multiple tiers and which can be prepared in a variety of container sizes.

It is an additional objective of the present invention to provide a plastic container as aforesaid which is resistant to vacuum and which is easy to use.

Further objects and advantages of the present invention will appear hereinbelow.

SUMMARY OF THE INVENTION

In accordance with the present invention the foregoing objects and advantages are readily obtained.

The plastic container of the present invention comprises:

a blow molded plastic container having a base portion with a generally centrally located depression therein, a finish portion opposite said base portion and a side wall extending therebetween;

said side wall including four side wall portions, with two of said side wall portions each including at least one generally centrally located outward protrusion, and the two other side wall portions each including at least one generally centrally located depression, wherein the outward protrusions of said container are nestable with depressions of additional containers and the side wall depressions of said container are nestable with outward protrusions of additional containers;

said finish portion including a generally centrally located, upwardly extending neck portion with an opening therein which is closable with a closure, wherein the upwardly extending neck portion of said container is nestable with a depression in the base portion of an additional container, and the depression in the base portion of said container is nestable with an upwardly extending neck portion of an additional container;

whereby, the base portion, finish portion and side wall portions of said container are nestable with a plurality of additional containers to provide a nested assembly of a plurality of containers.

Desirably, at least one additional inward depression is provided on each side wall, preferably extending laterally across each side wall portion. The container is preferably rectangular, with two longer side wall portions and two shorter side wall portions. Further features of the present invention will appear hereinbelow.

BRIEF DESCRIPTION OF THE DRAWINGS

The present invention will be more readily understandable from a consideration of the following illustrative drawings, wherein.

DETAILED DESCRIPTION OF PREFERRED EMBODIMENTS

Figure 1:
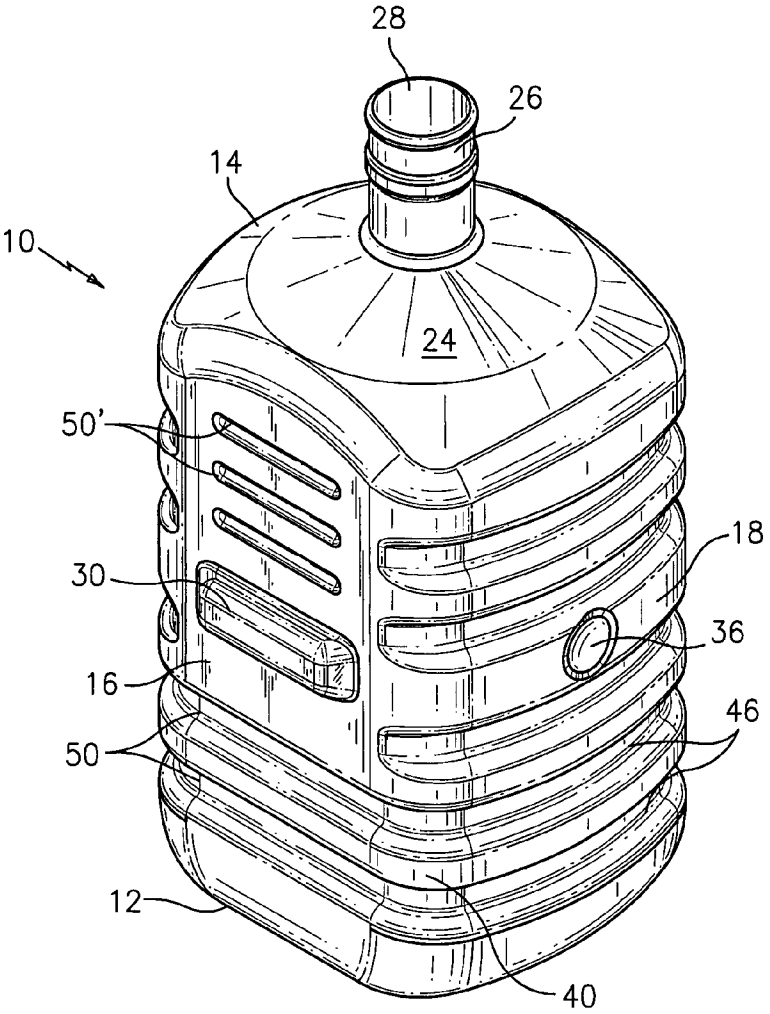
FIG. 1 is a perspective view of one embodiment of the container of the present invention showing the front and night side thereof.

Referring to the drawings, FIG. 1 shows a perspective view of a preferred embodiment of a container of the present invention. As shown in FIGS. 1–8, the container 10 is a blow molded plastic container having a base portion 12, a top or finish portion 14 opposite the base portion and four side wall portions extending therebetween, namely front side portion 16 (see FIG. 4), right side portion 18 (see FIG. 5), left side portion 20 (see FIG. 3), and rear side portion 22 (see FIG. 6). As clearly shown in the drawings, base portion 12 is connected to side wall portions 16, 18, 20 and 22. Moreover, the side portions extend downwardly from the top or finish portion and interconnect the top portion to the base portion to provide a container 10 with an essentially rectangular configuration. That is, container 10 has two longer side wall portions front side 16 and rear side 22, and two shorter side wall portions right side 18 and left side 20. However, one could provide the container of the present invention with an essentially square configuration.

Finish portion 14 is provided with a shoulder portion 24 and a generally centrally located, upwardly extending neck portion 26 with an opening therein which serves as a pouring spout and which is closable with a closure 28. If desired, the pouring spout could be provided with external threads or a snap-on closure could be used.

Figure 9:
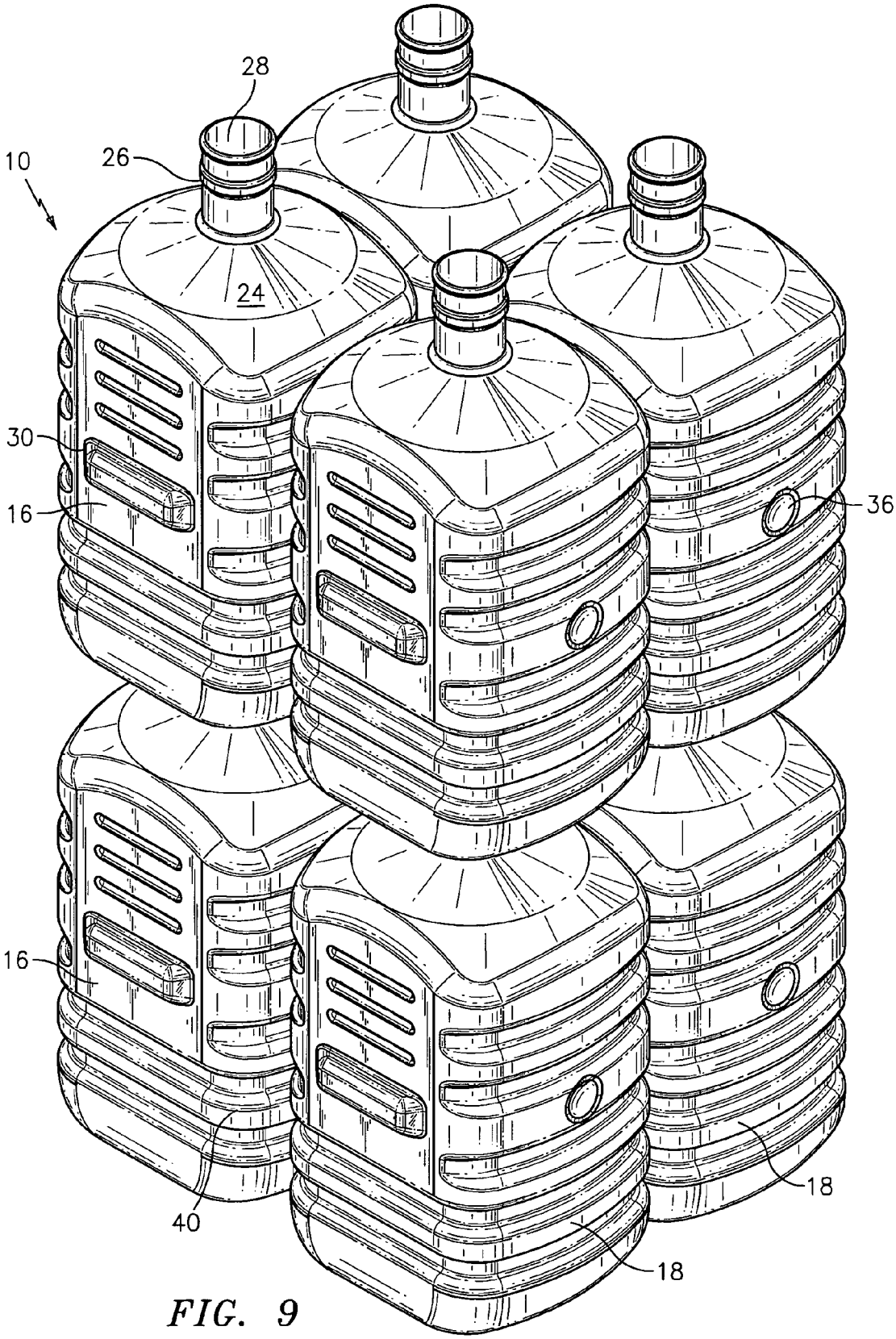
FIG. 9 is a perspective view of a plurality of containers of FIG. 1 stacked top to bottom.
Figure 10:
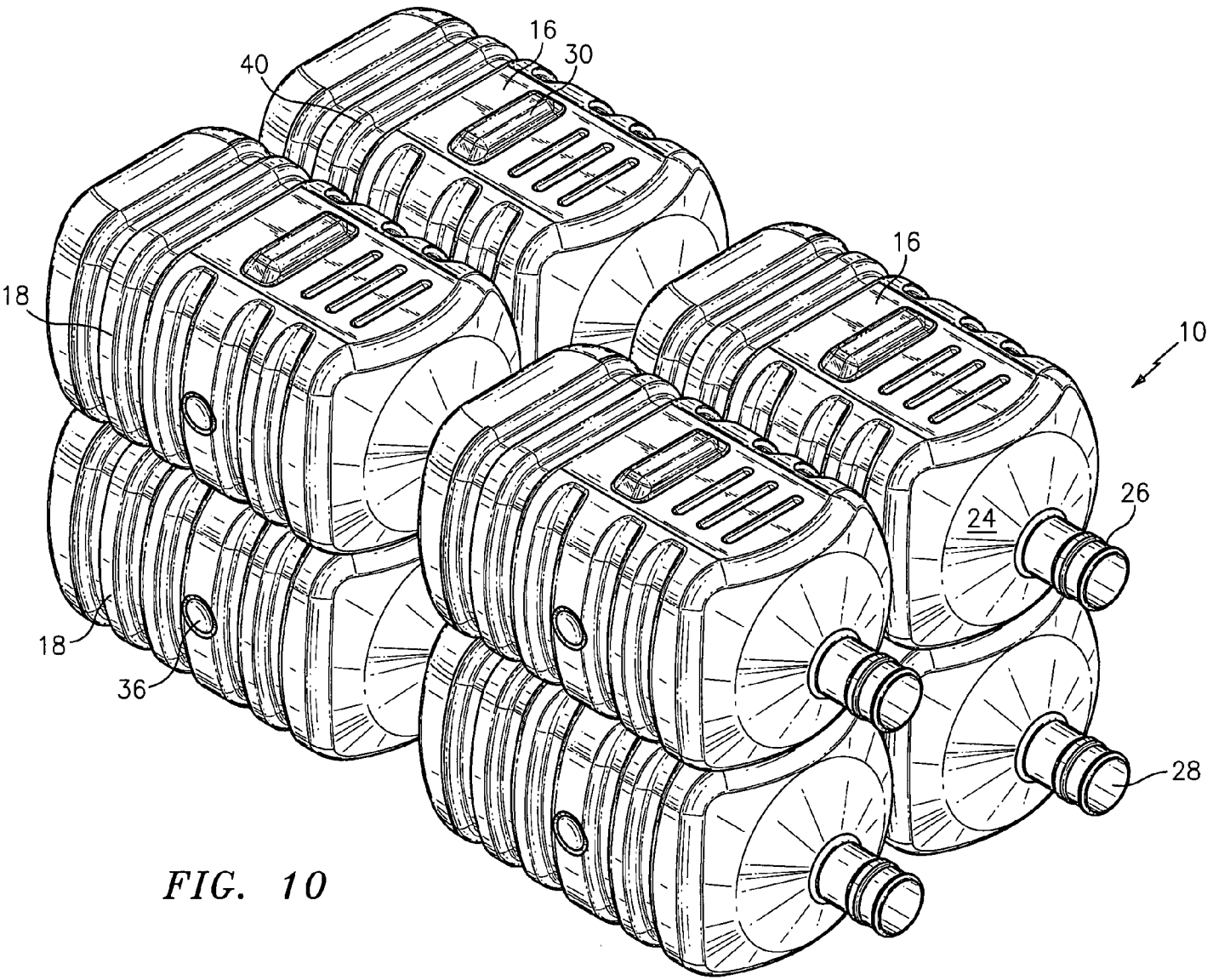
FIG. 10 is a perspective view of a plurality of containers of FIG. 1 stacked side to side.

As shown in the drawings, two of the side wall portions include at least one generally centrally located outward protrusion, and the two other side wall portions each include at least one generally centrally located depression. Thus, front side portion 16 includes centrally located, bar-like protrusion 30 and left side portion 20 includes centrally located, button like protrusion 32. Rear side portion 22 includes centrally located bar-like depression 34 and right side portion 18 includes centrally located, button-like depression 36. As shown in FIGS. 9–10, the outward protrusions 30, 32 of container 10 are nestable with the inward depressions 34, 36 of additional containers, and the inward depressions 34, 36 of container 10 are nestable with outward protrusions of additional containers, to provide a nested interrelationship. Naturally, the exact shape and configuration of the protrusions and depressions may be varied as desired to provide the desired nesting arrangement.

Figure 11:
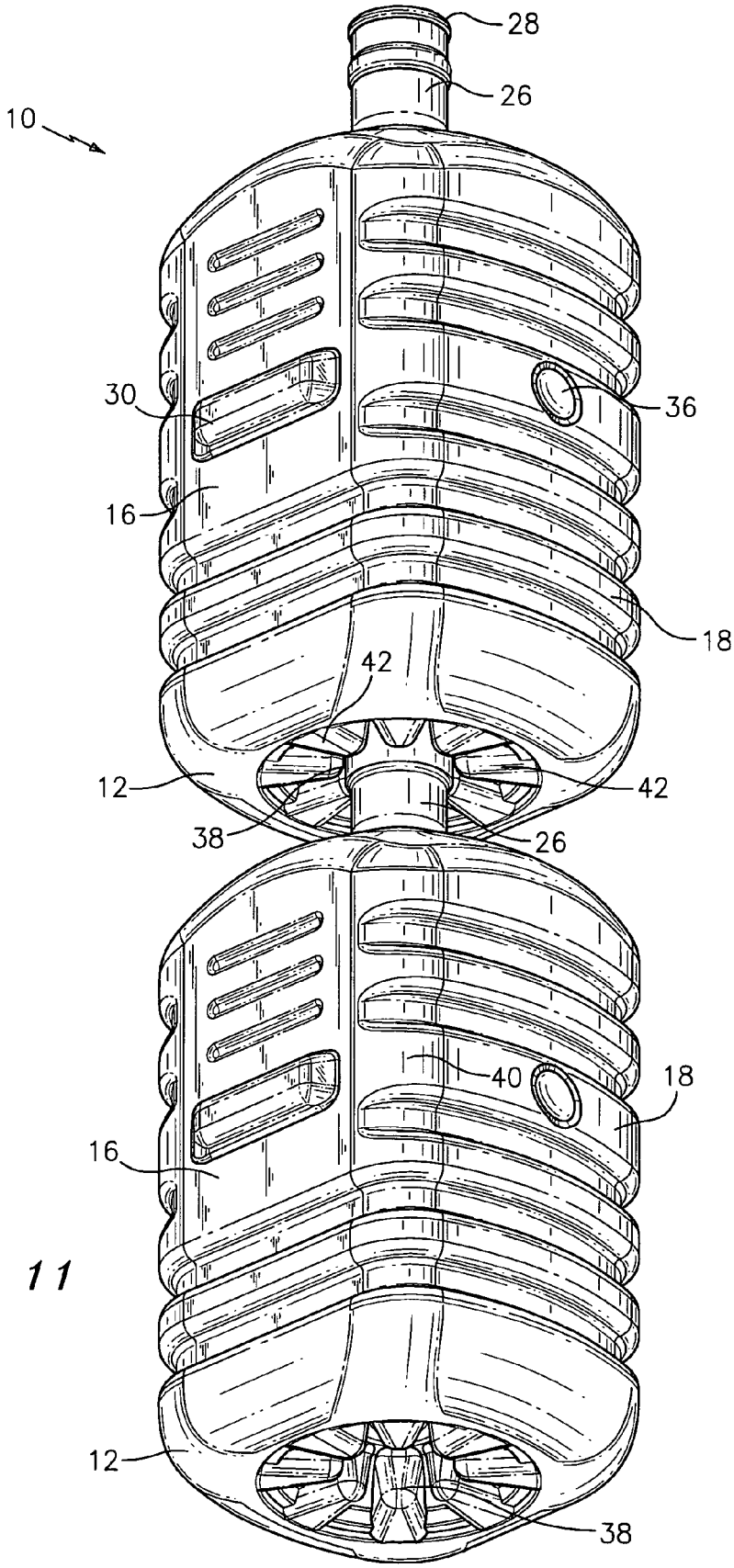
FIG. 11 is a perspective detail view of two containers of FIG. 1 stacked top to bottom.

In addition, the upwardly extending neck portion 26 with closure 28 thereon of container 10 is nestable with depression 38 in the base portion 12 of an additional container, and the depression 38 in the base portion of container 10 is nestable with an upwardly extending neck portion 26 with closure 28 thereon of an additional container. This is clearly shown in FIGS. 9–11.

Thus, as clearly shown in the drawings, the base portion, finish portion and side wall portions of the container of the present invention are nestable with a plurality of additional containers to provide a nested assembly of containers.

Desirably, the two opposed side wall portions 16 and 22 are essentially flat and the two opposed side wall portions 18 and 20 are slightly outwardly curved. The side wall portions are connected by side wall edge portions 40 which are preferably slightly curved.

Desirably, the base portion 12 includes a plurality of outward protrusions 42 surrounding the centrally located depression 38 in the base portion. Neck portion 26 is preferably essentially circular and when the neck portion is nested in the base portion of a further container the plurality of outward protrusions 42 in the base portion 12 surround the neck portion 26 of the nested container.

In addition to the foregoing the containers of the present invention are designed to resist vacuum. Thus, advantageously, the outward protrusions and inward depressions discussed above will resist vacuum. In addition and advantageously, the containers of the present invention will include at least one additional inward depression on each side wall portion as discussed hereinbelow.

Figure 2:
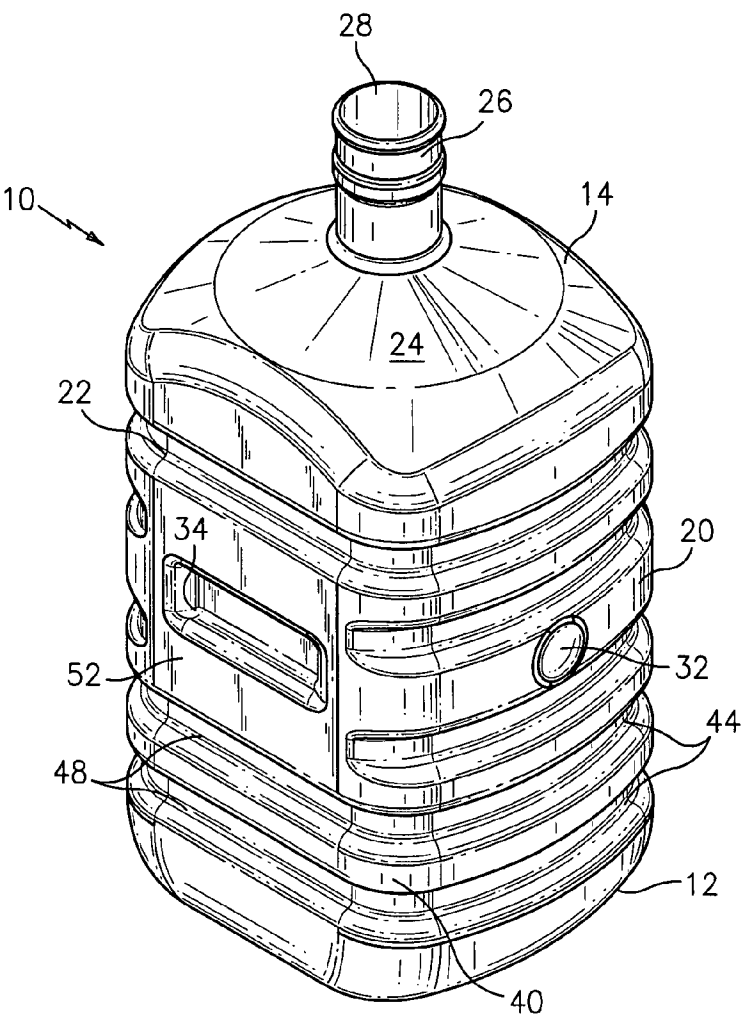
FIG. 2 is a perspective view of the container of FIG. 1 showing the rear and left side thereof.
Figure 4:
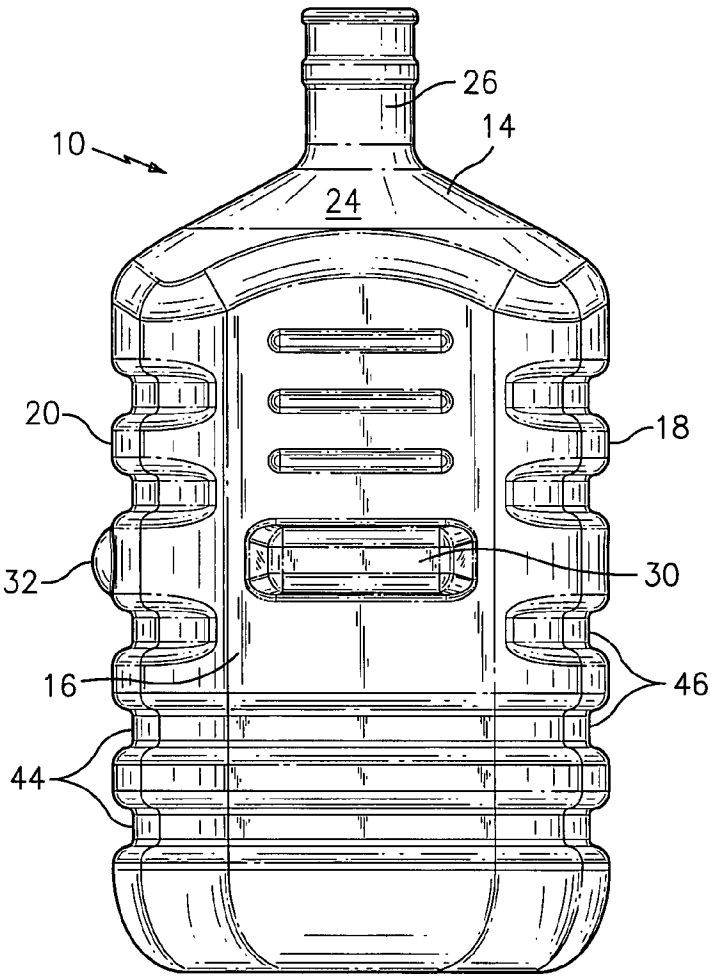
FIG. 4 is a side view of the container of FIG. 1 showing the front side thereof.
Figure 3:
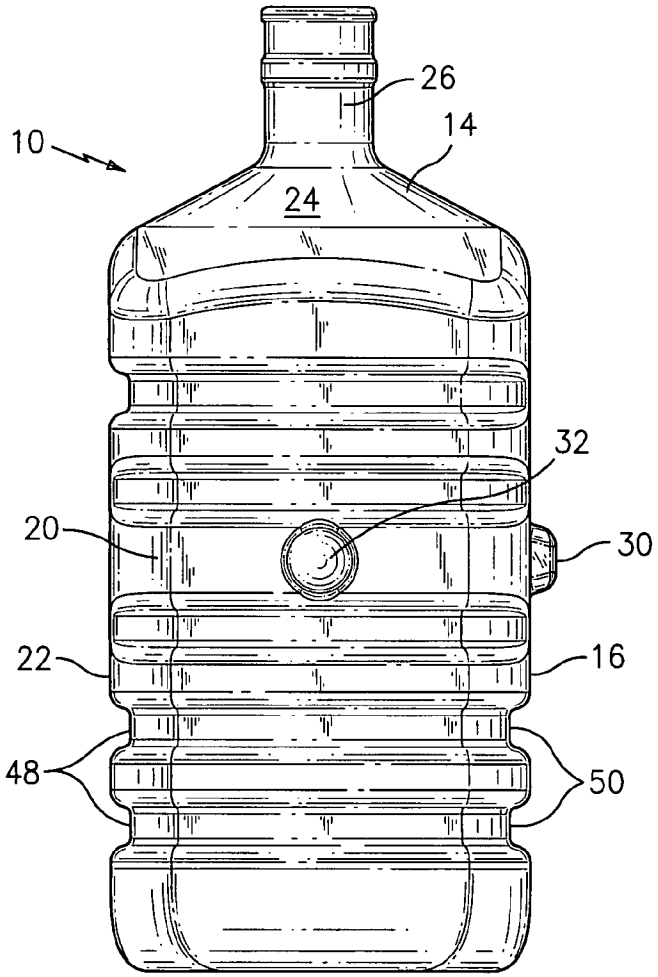
FIG. 3 is a side view of the container of FIG. 1 showing the left side thereof.
Figure 6:
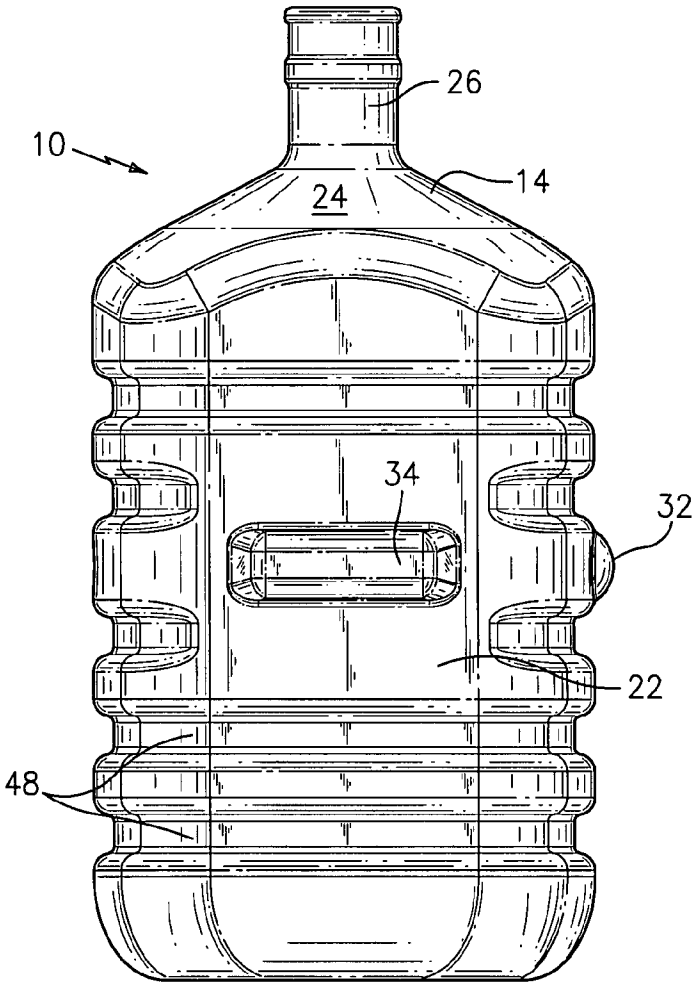
FIG. 6 is a side view of the container of FIG. 1 showing the rear side thereof.
Figure 5:
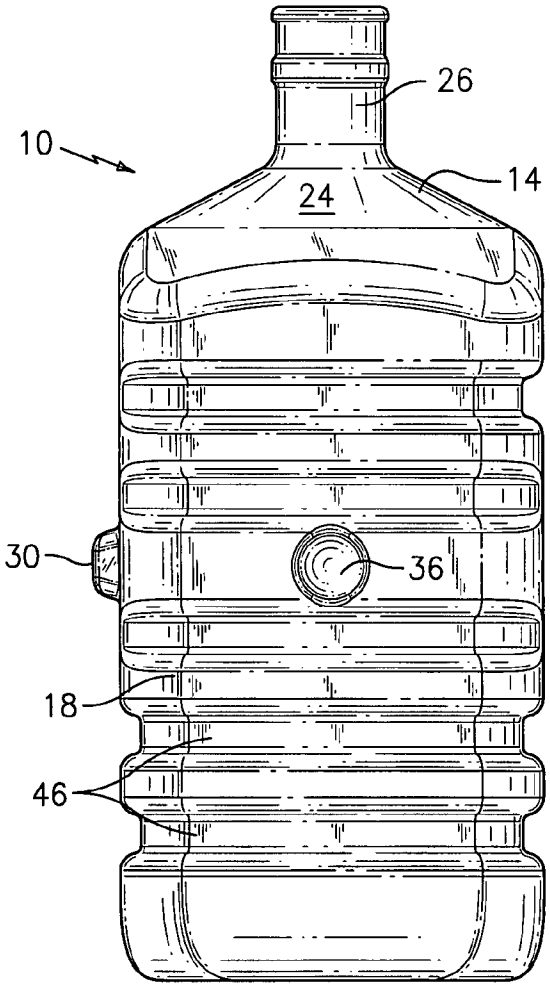
FIG. 5 is a side view of the container of FIG. 1 showing the right side thereof.
Figure 8:
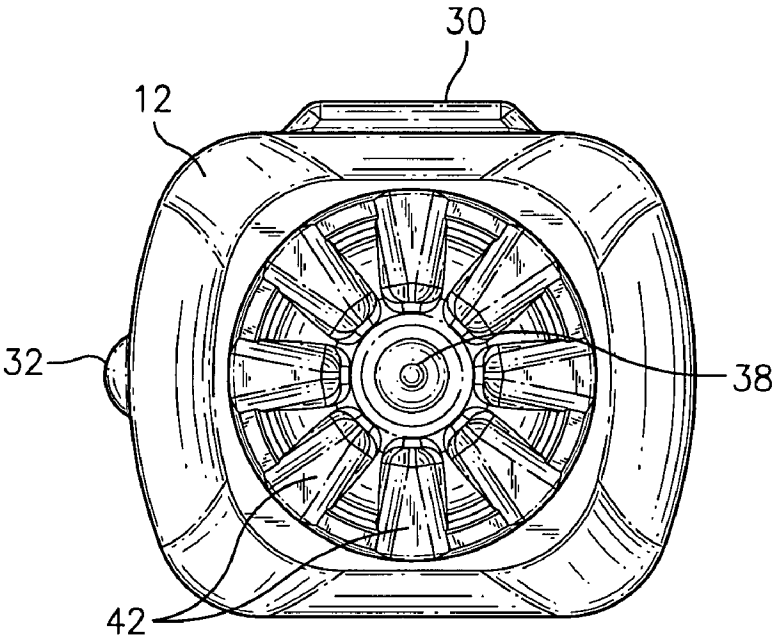
FIG. 8 is a bottom view of the container of FIG. 1.
Figure 7:
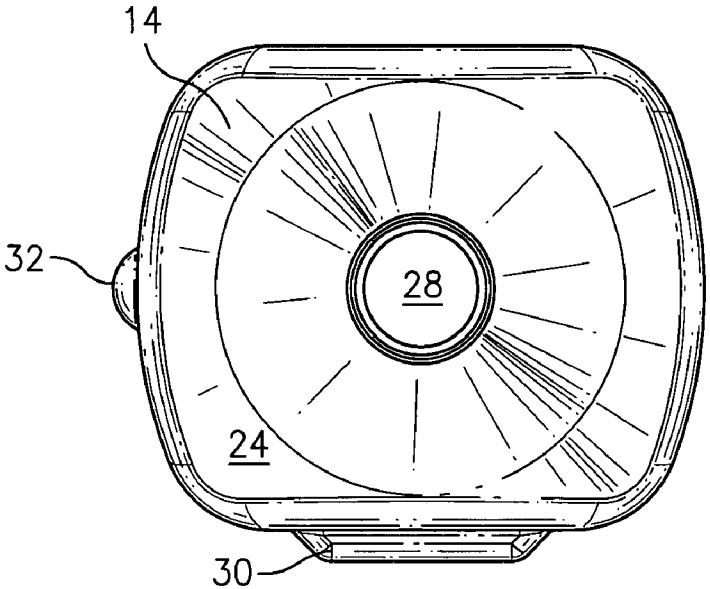
FIG. 7 is a top view of the container of FIG. 1.

Thus, referring to the drawings, FIGS. 2 and 4 clearly show left side wall portion 20 including a plurality of additional depressions 44, FIGS. 1 and 4 clearly show right side wall portion 18 including a plurality of additional depressions 46, FIGS. 2 and 3 clearly show rear side wall portion 22 including a plurality of additional depressions 48, and FIGS. 1 and 3 clearly show front side wall portion 16 including a plurality of additional depressions 50.

The additional depressions extend laterally across each side wall portion, and some are interconnected. Front side wall portion 16 includes three depressions 50 which extend part way across side wall 16 above protrusion 30. The flat area 52 surrounding depression 34 on rear side wall portion 22 can be used as a label panel. Naturally, different arrangements and orientation of the additional depressions can be used.

Figure 12:
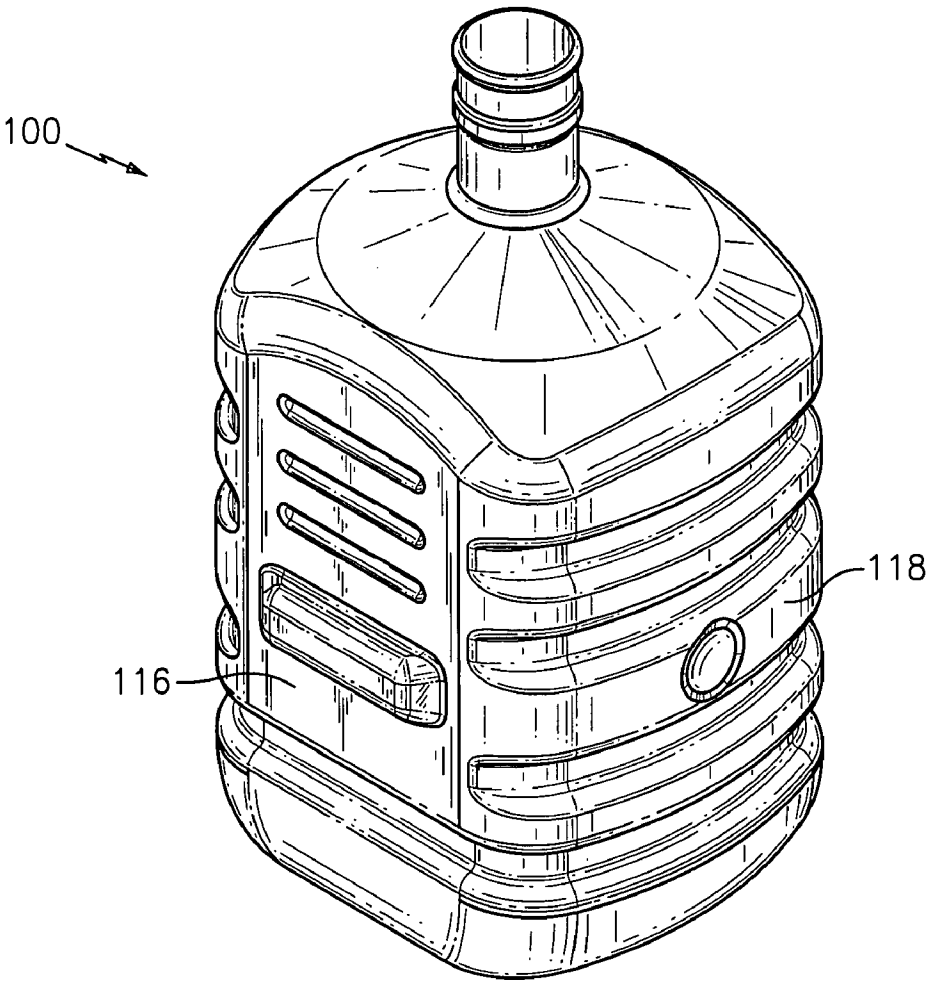
FIG. 12 is a perspective: view of an alternate embodiment of the container of the present invention showing the front and right side thereof.

FIG. 12 shows an alternate embodiment in container 100 showing a perspective view with front side wall portion 116 and right side wall portion 118. Container 100 is similar to container 10 except that it is smaller in size with fewer of the additional depressions. Container 100 will nest with other similar containers in the same manner as container 10.

The container of the present invention is particularly advantageous for larger sizes, although any size can be used. Preferably the containers of the present invention have a capacity of at least two gallons, and advantageously from three to five gallons.

Any desirable plastic material can be used, as polyethylene terephthalate.

The containers of the present invention are particularly advantageous. They permit stacking that resists falling over while on display or during shipment. The interlocking features allow the containers to be stacked automatically or hand stacked. In view of the configuration of the containers the unit load will not fall over and requires very minimum packaging for distribution to the trade. The unique stacking configuration eliminates excessive packaging and shipping costs normally associated with large size containers and permits highly desirable displays. The interlocking neck to base arrangement permits stacking of the filled containers without expensive framing costs. One can efficiently use store space for an effective display. The container is desirably non-returnable and can be made of lighter weight than normally for the larger size containers.

The recycle nature of polyethylene terephthalate and the lighter weight make this container highly desirable as a no deposit container. Moreoever, the container is highly attractive for use in a water cooler.

In addition and advantageously, the containers of the present invention will resist vacuum, thus providing containers with numerous significant desirable features.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container, which comprises:

a blow molded plastic container having a base portion with a generally centrally located depression therein, a finish portion opposite said base portion, and a side wall extending therebetween;

said side wall including four side walls with two of said side walls each including at least one generally centrally located outward protrusion and the two other side walls each including at least one generally centrally located depression, wherein one of said centrally located outward protrusions is a bar shaped protrusion and the other of said centrally located outward protrusions is a button shaped protrusion, and wherein the outward protrusions of said container are nestable with depressions of additional containers, and the side wall depressions of said container are nestable with outward protrusions of additional containers;

said finish portion including a generally centrally located, upwardly extending neck portion with an opening therein which is closable with a closure, wherein the upwardly extending neck portion of said container is nestable with a depression in the base portion of an additional container, and the depression in the base portion of said container is nestable with an upwardly extending neck portion of an additional container;

whereby, the base portion, finish portion and side walls of said container are nestable with a plurality of additional containers to provide a nested assembly of a plurality of containers.

2. A plastic container according to claim 1, including at least two inward depressions on each side wall, one of which is above and one below each central protrusion and one of which is above and one below each central depression.

3. A plastic container according to claim 2, wherein each of said additional depressions extend laterally across each side wall.

4. A plastic container according to claim 3, wherein at least one of said side walls includes a plurality of said additional inward depressions, and wherein at least one of said additional depressions extends continuously around said container.

5. A plastic container according to claim 3, wherein a side wall with a central protrusion therein includes at least two of said additional depressions above said central protrusion and at least two of said additional depressions below said central protrusion.

6. A plastic container according to claim 3, wherein a side wall with a central depression therein includes at least two of said additional depressions above said central depression and at least two of said additional depressions below said central depression.

7. A plastic container according to claim 2, wherein said container is essentially rectangular, with two longer side walls and two shorter side walls.

8. A plastic container according to claim 7, wherein said side walls are connected by side wall edge portions.

9. A plastic container according to claim 8, wherein said sidewall edge portions are curved.

10. A plastic container according to claim 8, wherein two opposed side walls are essentially flat and two opposed side walls are slightly outwardly curved.

11. A plastic container according to claim 2, including a plurality of outward protrusions surrounding the centrally located depression of the base portion.

12. A plastic container according to claim 11, wherein said neck portion is circular, and wherein said plurality of outward protrusions surrounding the depression of the base portion surround the neck portion of an additional container nestable in the base portion of said container.

13. A plastic container according to claim 1, wherein said container has a capacity of at least two gallons.

14. A plastic container according to claim 13, wherein said container has a capacity of from three to five gallons.

15. A plastic container according to claim 1, wherein two of said side walls each include a single generally centrally located outward protrusion, and the two other side walls each include a single generally centrally located depression.

16. A plastic container according to claim 1, wherein said bar shaped protrusion extends partway across a side wall.

17. A plastic container according to claim 1, wherein an adjacent two of said side walls each include at least one generally centrally located outward protrusion, and an adjacent two other side walls each include at least one generally centrally located depression.

* * * * *